US010156418B2

(12) United States Patent
Nystrom

(10) Patent No.: US 10,156,418 B2
(45) Date of Patent: Dec. 18, 2018

(54) ARROW REST

(71) Applicant: Dan Nystrom, Liberty, MO (US)

(72) Inventor: Dan Nystrom, Liberty, MO (US)

( * ) Notice: Subject to any disclaimer, the term of this patent is extended or adjusted under 35 U.S.C. 154(b) by 0 days.

(21) Appl. No.: 15/337,198

(22) Filed: Oct. 28, 2016

(65) Prior Publication Data

US 2017/0074614 A1 Mar. 16, 2017

Related U.S. Application Data

(63) Continuation of application No. 13/829,083, filed on Mar. 14, 2013.

(51) Int. Cl.
*F41B 5/14* (2006.01)

(52) U.S. Cl.
CPC ..... *F41B 5/143* (2013.01)

(58) Field of Classification Search
CPC ..... F41B 5/143; F41B 5/14; F41B 5/1484
See application file for complete search history.

(56) References Cited

U.S. PATENT DOCUMENTS 4,574,423 A * 3/1986 Ito ..... E05F 3/14 16/342
4,685,439 A 8/1987 Cosentino, Jr.
4,809,371 A 3/1989 Spitz
4,865,007 A 3/1989 Saunders
5,143,043 A * 9/1992 Brelsford ..... F41B 5/14 124/24.1
5,365,912 A 11/1994 Pittman
5,415,154 A 5/1995 Angeloni
6,044,832 A 4/2000 Piersons, Jr.
6,102,020 A 8/2000 Mizek et al.
6,202,635 B1 3/2001 Evans
6,595,195 B1 7/2003 Barner et al.
6,615,813 B1 9/2003 Troncoso, Jr. et al.
6,789,536 B1 1/2004 Summers
6,688,297 B1 2/2004 Clague
6,739,321 B1 5/2004 Puchlerz
6,782,881 B2 8/2004 Mizek et al.
6,823,856 B2 11/2004 Rager
7,331,338 B2 2/2008 Mizek
7,409,950 B2 8/2008 Ellig et al.
8,434,464 B1 5/2013 Terzo
8,474,443 B2 * 7/2013 Geno ..... F41B 5/143 124/44.5
9,341,433 B1 * 5/2016 Summers ..... F41B 5/143
(Continued)

OTHER PUBLICATIONS

Office Action dated May 19, 2015, in U.S. Appl. No. 13/829,083, filed Mar. 14, 2013.

(Continued)

*Primary Examiner* — Melba Bumgarner
*Assistant Examiner* — Amir Klayman
(74) *Attorney, Agent, or Firm* — Hovey Williams LLP

(57) ABSTRACT

A drop-away arrow rest for an archery bow is provided that utilizes a torque transfer system to transfer a rotational motion from an actuation element to a launcher configured to support the shaft of an arrow when the launcher is in an up position. The rotational motion causes the launcher to rotate from an up position to a down position while the archery bow is shot. After the arrow has cleared the launcher, the arrow rest described herein is configured to automatically return to the up position.

8 Claims, 10 Drawing Sheets

(56) References Cited

U.S. PATENT DOCUMENTS

| | | | | |
|---|---|---|---|---|
| 2006/0157038 | A1 | 7/2006 | Ellig et al. | |
| 2009/0277735 | A1* | 11/2009 | Yamaguchi | F16F 9/12 188/290 |
| 2014/0190462 | A1* | 7/2014 | Khoshnood | F41B 5/143 124/86 |

OTHER PUBLICATIONS

Office Action dated Nov. 12, 2015, in U.S. Appl. No. 13/829,083, filed Mar. 14, 2013.

* cited by examiner

ARROW REST

RELATED APPLICATIONS

This application is a continuation of U.S. patent application Ser. No. 13/829,083, filed Mar. 14, 2013, which claims the priority benefit under 35 U.S.C. § 119(e) of U.S. Provisional Patent Application Ser. 61/616,508 entitled "Archery Arrow Rest Apparatus," filed Mar. 28, 2012, the entire disclosures of which are incorporated herein by reference.

BACKGROUND

1. Field of the Invention

The present invention relates generally to arrow rests for use with archery bows. More specifically, the present invention relates generally to drop-away arrow rests.

2. Description of the Related Art

An arrow rest is an apparatus that is attached to an archery bow for the purpose of holding and precisely locating an arrow during the shot by the archer. A typical arrow rest is generally composed of a main body and an arrangement of fingers or other implements used to cradle the arrow shaft and position it for the shot.

An increasingly popular type of arrow rest is commonly referred to as a "drop-away" arrow rest. A drop-away arrow rest provides the archer with an apparatus that precisely positions the arrow for the shot, but then quickly moves out of the path of the arrow at some point during the shot to allow clearance for the arrow fletching. A drop-away arrow rest is advantageous in that it eliminates any interference between the arrow rest and the flight of the arrow.

There are three basic types of drop-away rests. The first type is one that starts the shot cycle with the rest in the "down" position and is urged into the "up" position via a mechanism activated by the drawing of the bow by the archer. Upon firing the bow, the rest immediately begins to fall out of the way of the arrow path via spring tension. A second type of drop-away arrow rest is one that starts the shot cycle with the rest in the "down" position and is urged into the "up" position via spring tension by way of a mechanism activated by the drawing of the bow by the archer. Upon firing the bow, the rest stays in the "up" position during the shot and is forced out of the way of the arrow path via a mechanism attached to a moving portion of the bow. Both of these types of drop-away rests raise the arrow from a resting position (i.e., the down position) into a pre-launch condition (i.e., the up position). This raising of the arrow is detrimental in that the arrow has a tendency to come off the rest while in motion during the draw.

A third type of drop-away arrow rest is one that is "cocked" into the "up" position by the archer against spring tension. Upon drawing the bow, a mechanism engages the cocked rest and disengages it immediately upon firing thereby dropping the rest out of the path of the arrow. However, in order to use this particular arrow rest, the archer must "recock" the rest after each shot.

Although advances have been made in the field of drop-away arrow rests, improvements are still needed.

SUMMARY

One embodiment of the present invention concerns an arrow rest system for supporting an arrow relative to an archery bow. The arrow rest system comprises a launcher configured to support the shaft of the arrow when the launcher is in an up position; an actuation arm configured to be rotated by the archery bow when the archery bow is shot; and a rotary damper configured to provide a torque-dependent motion transmittal from the actuation arm to the launcher so that when the archery bow is shot the launcher is rotated from the up position to a down position.

Another embodiment of the present invention concerns an arrow rest system for supporting an arrow relative to an archery bow. The arrow rest system comprises a launcher configured to support the shaft of the arrow when the launcher is in an up position; an actuation element configured to be rotated by the archery bow from an initial position to an actuated position when the archery bow is shot; and a speed-sensitive torque transfer system configured to transfer at least a portion of the rotating motion of the actuating element to the launcher so that when the archery bow is shot the actuation element rotates the launcher from the up position to a down position.

Yet another embodiment of the present invention concerns an arrow rest system for supporting an arrow relative to an archery bow. The arrow rest system comprises a launcher configured to support the shaft of the arrow when the launcher is in an up position; an actuation element configured to be rotated by the archery bow from an initial position to an actuated position when the archery bow is shot; and a torque transfer system configured to transfer at least a portion of the rotating motion of the actuating element to the launcher so that when the archery bow is shot the actuation element rotates the launcher from the up position to a down position. The actuation element rotates from an initial position to an actuated position through an angle A and the launcher rotates from the up position to the down position through an angle B. In this embodiment, A is at least 5 degrees greater than B.

Still yet another embodiment of the present invention concerns a method for operating an arrow rest system. The method comprises (a) rotating an actuation arm from an initial position, through an angle A, to an actuated position; and (b) transferring a portion of the rotational motion of the actuation arm to an arrow support launcher to thereby rotate the launcher from an up position, through an angle B, to a down position. In this embodiment, A is at least 5 degrees greater than B.

BRIEF DESCRIPTION OF THE FIGURES

Embodiments of the present invention are described herein with reference to the following drawing figures, wherein.

DETAILED DESCRIPTION

The arrow rest of the present invention addresses many of the issues inherent in prior art arrow rests. The arrow rest described herein is simple to load, operate, and maintain compared to previous arrow rests. In one or more embodiments described herein, a drop-away arrow rest is provided that stays in contact with the arrow for a longer duration during the shot, provides full containment for the arrow loaded on the rest, and does not need to be cocked or reset by the archer. Furthermore, the arrow rest described herein may not contribute to the tension in the cam system of the archery bow when at full draw.

Figure 1:
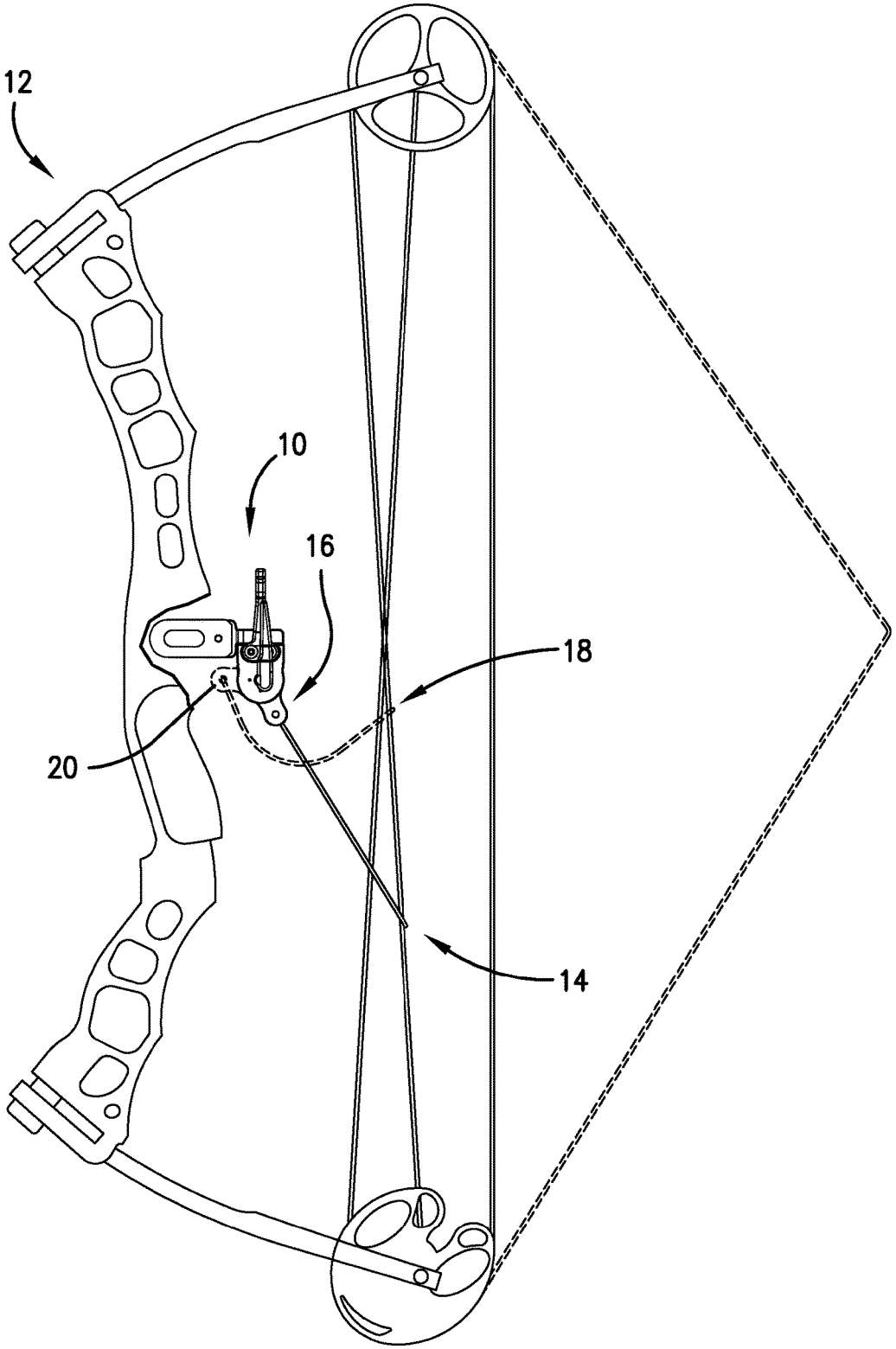
FIG. 1 is a side view of the arrow rest in accordance with one embodiment of the present invention, particularly illustrating the arrow rest connected to an archery bow.
Figure 13:
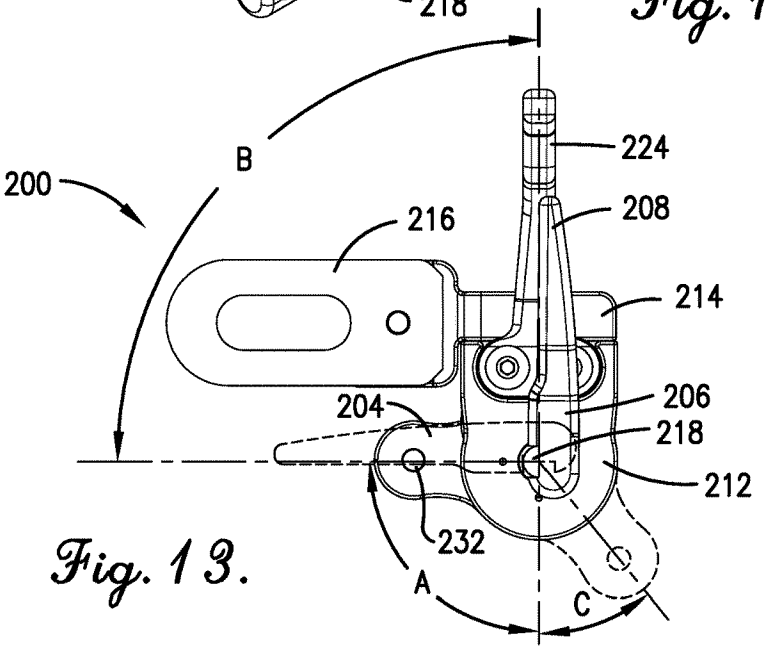
FIG. 13 is a side view of the assembled arrow rest depicted in FIG. 8, particularly illustrating the initial and actuated positions of the actuation element and the up and down positions of the launcher.

The present invention is directed to a drop-away arrow rest for an archery bow that utilizes a torque transfer system to transfer a rotational motion from an actuation element to a launcher configured to support the shaft of an arrow when the launcher is in an up position. The actuation element is configured to be rotated by the archery bow from an initial position to an actuated position when the archery bow is shot. This rotational motion from the actuation element causes the launcher to rotate from an up position to a down position while the archery bow is shot. After the arrow has cleared the launcher, the arrow rest is configured to automatically return to the up position As shown in FIG. 1, the arrow rests described herein can be attached to an archery bow to facilitate subsequent shooting of the bow. Furthermore, as shown in FIGS. 2, 3, 8, and 9 and discussed below in more detail, the arrow rests described herein generally comprise a torque transfer system, an actuation element, and an arrow support launcher configured to move from an up position to a down position. In particular, as shown in FIG. 13, the actuation element can be rotated from an initial position to an actuated position to provide a rotational motion that causes the launcher to rotate from the up position to the down position.

As used herein, a "torque transfer system" is defined as any system configured to transfer a torque from a first element to a second element via a mechanical transfer mechanism. In one embodiment, the torque transfer system can be configured to transfer a rotational motion from the actuation element to the launcher so that when the archery bow is shot the launcher is rotated.

In one or more embodiments, the mechanical transfer mechanism comprises a viscous fluid. In such embodiments, the torque transfer system can be referred to as a viscous fluid torque transfer system. Examples of viscous fluid torque transfer systems include a rotary damper and a Hele-Shaw clutch. The viscous fluid can have a viscosity of at least 5, 10, 20, 50, 75, 100, 250, 500, 1,000, or 5,000 centistokes at 25° C. In one embodiment, the viscous fluid is a silicon oil. In another embodiment, the viscous fluid is in the form of a gel.

In certain embodiments, the viscous fluid torque transfer system comprises a rotary damper. In certain embodiments, the rotary damper can transfer a torque-dependent motion transmittal to the launcher from the actuation element. In one or more embodiments, the rotary damper can be unidirectional, bi-directional, or a combination thereof. In various embodiments, the rotary damper can have a torque rating of at least 1, 2, 3, 4, 5, 6, 7, 8, 9, or 10 N-cm at 20 rpm. Additionally or alternatively, the rotary damper can have a rotation speed of at least 10, 20, 30, 40, 50, or 75 and/or not more than 1,000, 500, 300, or 100 rpm.

In one or more embodiments, the mechanical transfer mechanism comprises weight arms connected to a first element that move outwardly and engage a second element when the first element is rotated. In such embodiments, the torque transfer system can be referred to as a centrifugal force torque transfer system. An example of a centrifugal force torque transfer system is a centrifugal clutch.

In one or more embodiments, the torque transfer system can comprise a speed-sensitive torque transfer system. As used herein, "speed-sensitive torque transfer system" is understood to comprise a torque transfer system that is configured to engage at high rotational speeds and not engage at lower rotational speeds. These speed-sensitive torque transfer systems can comprise a viscous fluid torque transfer system and/or a centrifugal force torque transfer system as described above.

The actuation element in the arrow rests can be configured to provide a rotational motion used to move the launcher from the up position to the down position. An example of an actuation element includes an actuation arm. In one or more embodiments, the actuation element can be rotated by the archery bow when the archery bow is shot, thereby providing the rotational motion. In various embodiments, the actuation element is configured to rotate from an initial position to an actuated position thereby creating the rotational motion. Additionally, the actuation element can be configured to automatically rotate from the actuated position to the initial position when the archery bow is drawn back. In certain embodiments, the actuation element is configured to automatically remain in the actuated position after the archery bow has been shot and before the archery bow is drawn back again.

In one or more embodiments, the actuation element is connected to a moving portion of the archery bow that provides the rotational motion to the actuation element. In such embodiments, the moving portion can comprise a buss cable of the archery bow that moves up when the bow is drawn. Consequently, in such embodiments, the connection point of the actuation element on the buss cable relative to the arrow rest can vary depending on the shot condition of the bow. For example, the connection point of the actuation element will be lower relative to the arrow rest when the bow is in the undrawn state compared to when the bow is in the drawn state, when the buss cable has moved up. In certain embodiments, the actuation element is connected to the moving portion of the bow at an undrawn state at angle X and a drawn state at angle Y, wherein both X and Y are measured relative to the location of the arrow rest on the bow. In such an embodiment, X can be at least 5, 10, 15, 20, 30, or 40 degrees greater than Y. In various embodiments, the actuation element is connected to the moving portion of the bow using a flexible linkage or cord. The actuation element can be connected to the moving portion of the bow at a point that is at least 1, 3, 5, 7, 8, 9, or 10 inches below the arrow rest.

The launcher can be configured to support an arrow shaft before and during the shot when the launcher is in an up position. Additionally, the launcher can also be configured to rotate into a down position at some point during the shot in order to avoid interfering with the trajectory of the arrow. In one or more embodiments, the torque transfer system transfers the rotational motion from the actuation element to the launcher, which causes the launcher to rotate from the up position to the down position.

In one or more embodiments, the launcher is configured to automatically rotate from the down position to the up position after the archery bow has been shot and the arrow has cleared the rest. In another embodiment, the launcher is configured to automatically remain in the up position at all times other than when the archery bow is shot and immediately after the archery bow is shot.

The arrow rest system described herein can also comprise various other components in its assembly. In one or more embodiments, the arrow rest comprises an axle. In various embodiments, the axle adjoins many of the components within the arrow rest. In certain embodiments, the launcher and/or actuation element are configured to rotate around the axle. For example, the motion of the launcher can be partially controlled by the rotation of the axle.

In one or more embodiments, the arrow rest comprises a biasing system configured to transfer the rotational motion between the actuation element, torque transfer system, and launcher. For example, the biasing system can comprise one or more springs.

In one embodiment, the biasing system comprises a launcher biasing element configured to return the launcher from the down position to the up position. In such an embodiment, the launcher biasing element can comprise a spring. In another embodiment, the torque transfer system can be configured to momentarily overcome the torsion of the launcher biasing element thereby causing the launcher to rotate from the up position to the down position.

In one embodiment, the biasing system comprises an actuation biasing element configured to return the actuation element from the actuated position to the initial position. In such an embodiment, the actuation biasing element can comprise a spring. In another embodiment, the actuation biasing element is configured to cause the actuation element to rotate around the axle.

In one or more embodiments, the arrow rest comprises a body for housing the components of the arrow rest and for attaching the arrow rest to the archery bow. In certain embodiments, the body can comprise a main body, a riser mount, and an adjustable vertical body. The main body can be configured to provide structure to the arrow rest and at least partially house many of the components in the rest. The riser mount can be used to attach the arrow rest to an archery bow. An example of a riser mount is an attachment arm. The adjustable vertical body can comprise an elevation and windage block which can adjust the position of the arrow rest.

In one or more embodiments, the launcher comprises a pair of launcher arms for containing an arrow. In certain embodiments, the arrow rest comprises a containment arm that extends over the launcher arms to provide containment for an arrow. In one embodiment, the containment arm is removable. In another embodiment, the containment arm is a containment brush constructed with stiff brush bristles. In yet another embodiment, the containment arm comprises a solid arm.

In one or more embodiments, the arrow rest comprises a stop configured to limit the rotation of the launcher from the up position to the down position. In various embodiments, the stop defines the down position of the launcher. The stop can be any apparatus or component that is capable of ceasing the rotation of the launcher. In one embodiment, the stop comprises a recessed arc that ceases the rotation of the launcher at a predetermined position. In another embodiment, the stop comprises an axle stop configured to stop the rotation of the axle and launcher at a predetermined position. In yet another embodiment, the stop can be located entirely within the housing of the body.

In one or more embodiments, the actuation element is configured to at least partially rotate past the stop thereby holding the launcher at the stop in the down position. As shown in FIG. 13, the actuation element rotates from the initial position to the actuated position through an actuation arm angle (angles A+C) and the launcher rotates from the up position to the down position through a launcher angle (angle B). In one or more embodiments, the actuation arm angle can be greater than the launcher angle. For example, the actuation arm angle can be at least 1, 3, 5, 10, 15, or 20 degrees greater than the launcher angle. In certain embodiments, the rotation of the actuation element past the stop is able to hold and maintain the launcher at the down position and prevent substantial bounce back from the launcher while in the down position. As used herein, "bounce back" refers to the tendency of the launcher to spontaneously and sporadically move from the down position while the arrow is being shot.

Another aspect of the present invention involves methods for operating the arrow rests described herein. In one embodiment, a method for operating the arrow rests described herein comprises (a) rotating an actuation element from an initial position, through an angle A, to an actuated position and (b) transferring a portion of the rotational motion of the actuation element to an arrow support launcher to thereby rotate the launcher from an up position, through an angle B, to a down position. In such an embodiment, angle A can be greater than angle B. In addition, the transferring of step (b) can be at least partly carried out using a speed-sensitive torque transfer system such as, for example, a rotary damper.

Furthermore, the method described above can further comprise automatically rotating the launcher from the down position to the up position using a launcher biasing element. This particular step can occur after the actuation element is at the actuated position. Additionally, the method described above can further comprise automatically rotating the actuation arm from the actuated position to the initial position using an actuation biasing element.

Additionally, the method described above can further comprise drawing back a bow onto which the arrow rest system is mounted, which can cause the actuation element to automatically rotate from the actuated position to the initial position. Moreover, the method described above can further comprise shooting an arrow from the bow by releasing the bow string from a drawn back position, which causes the rotating of step (a). In such an embodiment, the rotating of step (a) can be caused by transferring motion from a cable on the bow to the actuation element during the shooting. Furthermore, immediately after shooting, the launcher can be automatically returned to the up position while the actuation arm is automatically maintained in the actuated position.

In another embodiment of the method described above, angle A−angle B=angle C, which defines the rotation angle of the actuation element past the down position of the launcher to the actuated position. In such an embodiment, the launcher is maintained at the down position with substantially no bounce back while the actuation arm is rotating through angle C to the actuated position. This ensures that the launcher is being held down while the arrow passes above.

This invention can be further illustrated by the embodiments depicted in FIGS. 1-18, although it will be understood that these embodiments are included merely for the purposes of illustration and are not intended to limit the scope of the invention unless otherwise specifically indicated.

FIG. 1 depicts the arrow rest 10 attached to a compound bow 12. The actuation element of the arrow rest 10 is connected via a flexible linkage or cord to the buss cable of the bow 12, which moves up when the bow is drawn. As shown in FIG. 1, the connecting point of the flexible linkage of the arrow rest 10 to the buss cable can vary depending on the shot condition of the bow 12. For example, when the bow 12 is in an undrawn state (shown in solid lines), the flexible linkage of the arrow rest 10 can be connected to the buss cable at an undrawn position 14. While in the undrawn state, the actuation arm of the arrow rest 10 is in the actuated position 16 due to the tension in the flexible linkage connecting the arrow rest 10 and buss cable. In the drawn state of the bow 12 (indicated in dashed lines), the buss cable of the bow 12 moves up thereby also causing the connection point of the flexible linkage of the arrow rest 10 to move up to the drawn position 18. In the drawn state, the actuation arm of the arrow rest 10 moves to the initial position 20 due to the relaxed tension in the flexible linkage connecting the arrow rest 10 and buss cable. Thus, FIG. 1 shows that when the bow is drawn, the tension of the linkage connecting the arrow rest 10 and the buss cable is relaxed thereby allowing the actuation element to rotate from the actuated position 16 to the initial position 20.

Figure 2:
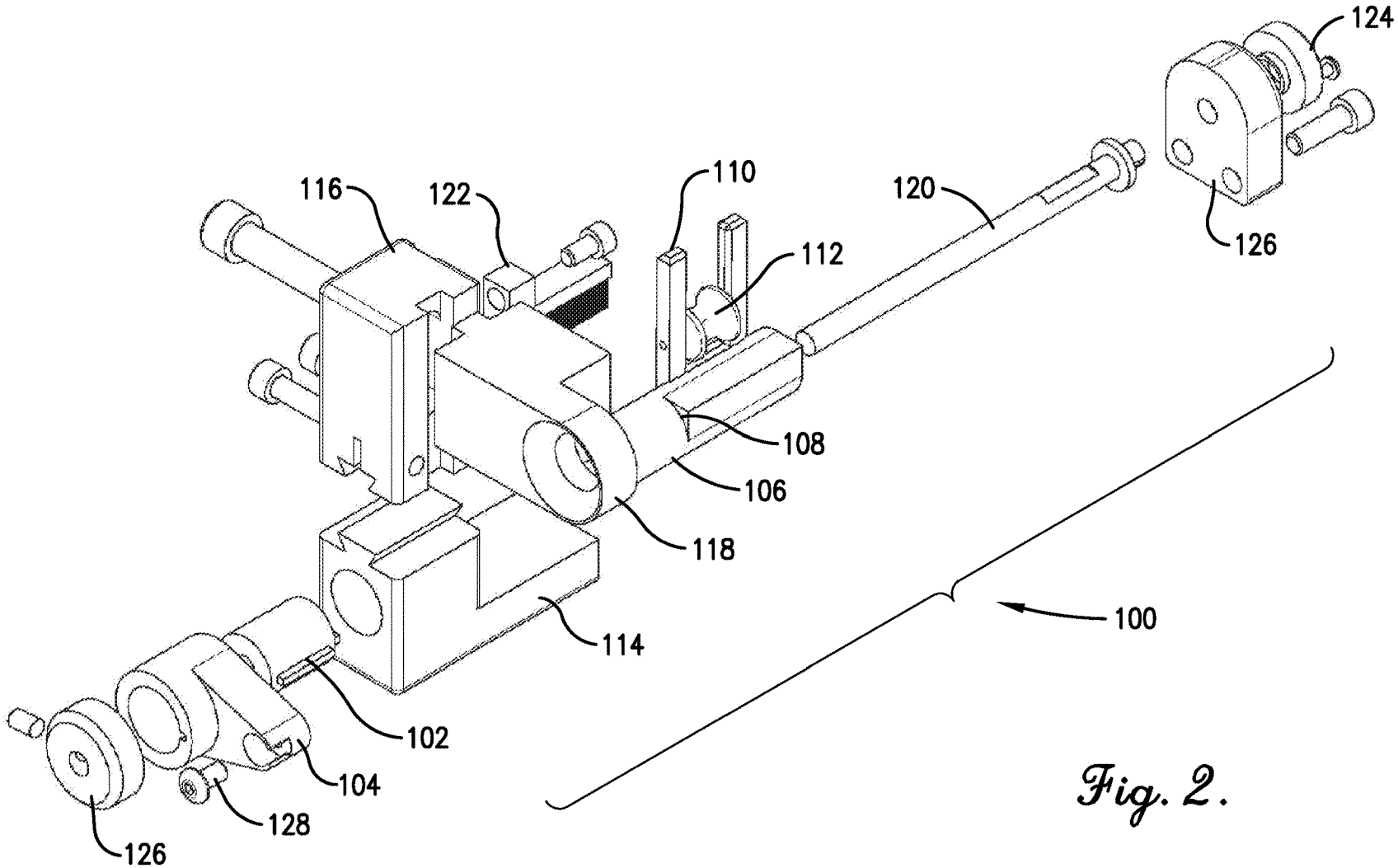
FIG. 2 is a frontal isometric exploded view of the arrow rest in accordance with one embodiment of the present invention.
Figure 3:
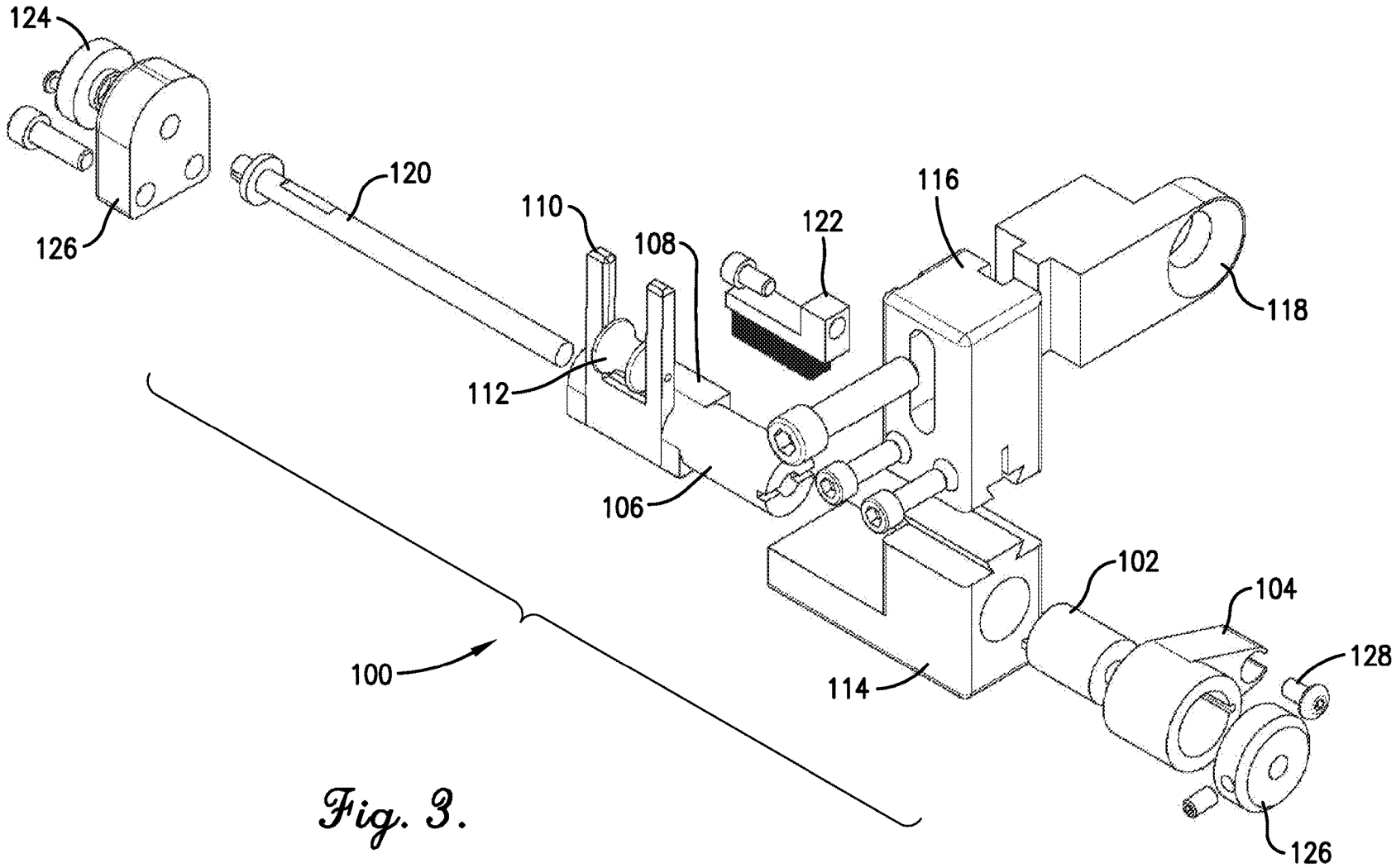
FIG. 3 is a rearward isometric exploded view of the arrow rest depicted in FIG. 2.
Figure 5:
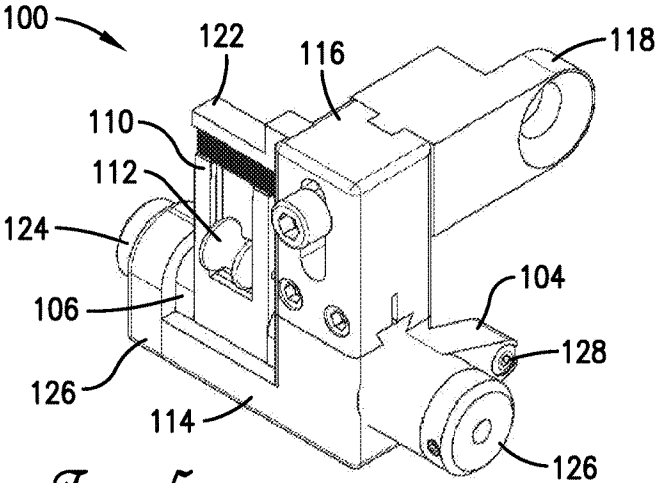
FIG. 5 is an isometric view of the assembled arrow rest depicted in FIG. 2.
Figure 7:
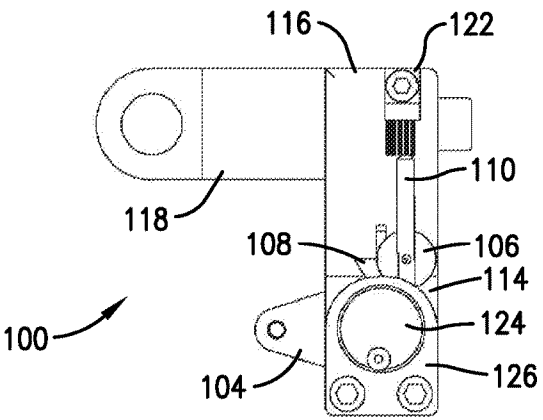
FIG. 7 is an elevation view of the assembled arrow rest depicted in FIG. 2.
Figure 4:
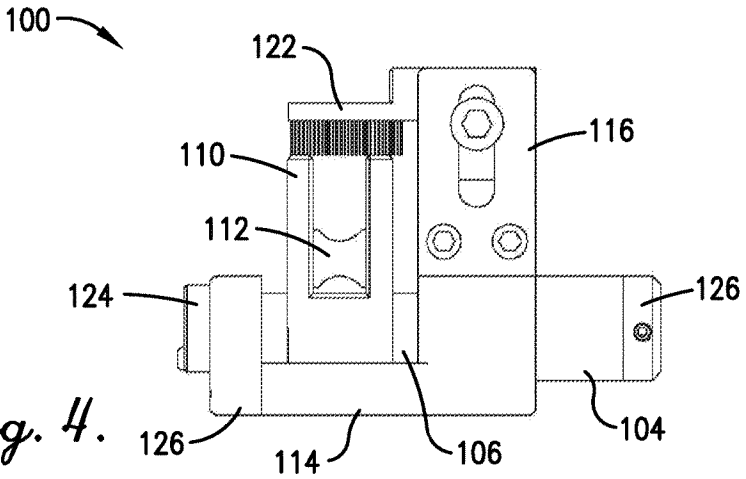
FIG. 4 is a side view of the assembled arrow rest depicted in FIG. 2.
Figure 6:
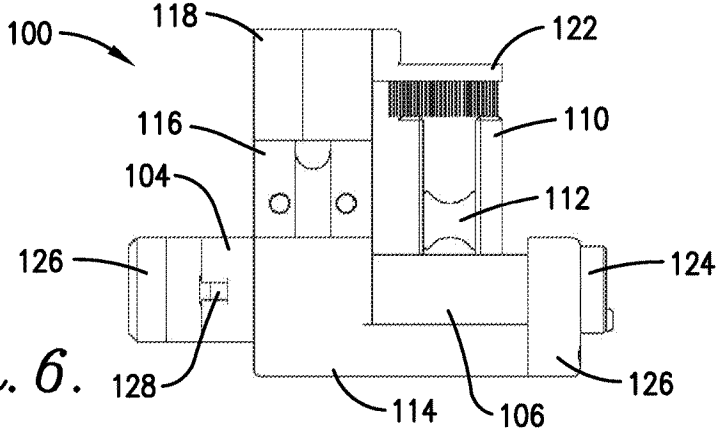
FIG. 6 is a side view of the assembled arrow rest depicted in FIG. 2.

FIGS. 2 and 3 depict alternative exploded views of one embodiment of the arrow rest described above. As shown in FIGS. 2 and 3, the arrow rest 100 contains a torque transfer system 102, an actuation element 104, and a launcher 106 that are all operably connected. In this particular embodiment, the torque transfer system 102 is a rotary damper, the actuation element 104 is an actuation arm, and the launcher 106 is in the up position. The actuation element 104 contains an actuation return spring (not shown) configured to urge the actuation element 104 into the initial position. The launcher 106 is also connected to a stop 108 in the form of a recessed arc and also contains a pair of launcher arms 110 designed to contain the arrow on the launcher 106. A launcher roller 112 is connected to the launcher arms 110 so as to allow for free rotation along its main axis to thereby provide a reduced friction surface upon which the arrow can be silently drawn across during the draw cycle.

The arrow rest 100 also contains a body made up of a main body 114, an adjustable vertical body 116, and a riser mount 118. The main body 114 provides structure to the arrow rest 100, while the riser mount 118 provides a mounting to connect the rest to an archery bow. The main body 114 also houses a main axle 120 that adjoins the torque transfer system 102, actuation element 104, and launcher 106. The main axle 120 governs the rotation of the launcher 106.

The vertical body 116 also has a removable containment arm 122 in the form of a containment brush affixed thereon. The containment arm 122 extends over the launcher arms 110 to provide containment for the archer's arrow. The arrow rest 100 depicted in FIGS. 2 and 3 also contain a spring housing cover 124 containing a launcher return spring (not shown), which is configured to maintain the launcher 106 at the launcher up position.

When the bow is drawn, the linkage (not shown) connecting the actuation element 104 to the buss cable (not shown) loses tension, thus allowing the actuation return spring to rotate the actuation element 104 around the main axle 120 into the initial position.

Upon release of the drawn bow string, the launcher 106 remains in the up position until sufficient slack in the flexible linkage connecting the actuation element 104 to the buss cable is taken up by the shot cycle of the bow. As the arrow fletching approaches the rest during the shot, the increasing tension in the flexible linkage connecting the actuation element 104 to the buss cable causes the actuation element 104 to overcome the torsion of the actuation return spring and rotate around the main axle 120 to the actuated position. Subsequently, the rotating actuation element 104 engages the torque transfer system 102 which in turn engages the launcher 106. During this time, the torque transfer system 104 can transfer the rotational motion from the actuation element 102 to the launcher 106, which momentarily overcomes the torsion of the launcher return spring in the spring housing cover 124 and thereby causes the launcher 106 to rotate to its down position and out of the path of the incoming arrow. The down position of the launcher 106 is defined by the stop 108. Upon completion of the shot, the launcher return spring returns the launcher 106 back to the up position.

The arrow rest 100 also contains end caps 126, which along with the main body 114, house the main axle 120 in such a manner so as to allow free rotation of the axle. The arrow rest 100 in this embodiment also utilizes an actuation attachment bolt 128 to connect the actuation element 104 to the buss cable of the archery bow via a linkage or cord.

FIGS. 4-7 depict alternative views of the assembled arrow rest embodiment shown in FIGS. 2 and 3. The launcher 106 in FIGS. 4-7 is shown in the up position. In particular, FIG. 4-7 further show how the actuation element 104, launcher 106, launcher arms 110, launcher roller 112, main body 114, adjustable vertical body 116, riser mount 118, containment arm 122, spring housing cover 124, end caps 126, and actuation attachment bolt 128 are operably connected in the arrow rest 100.

Figure 8:
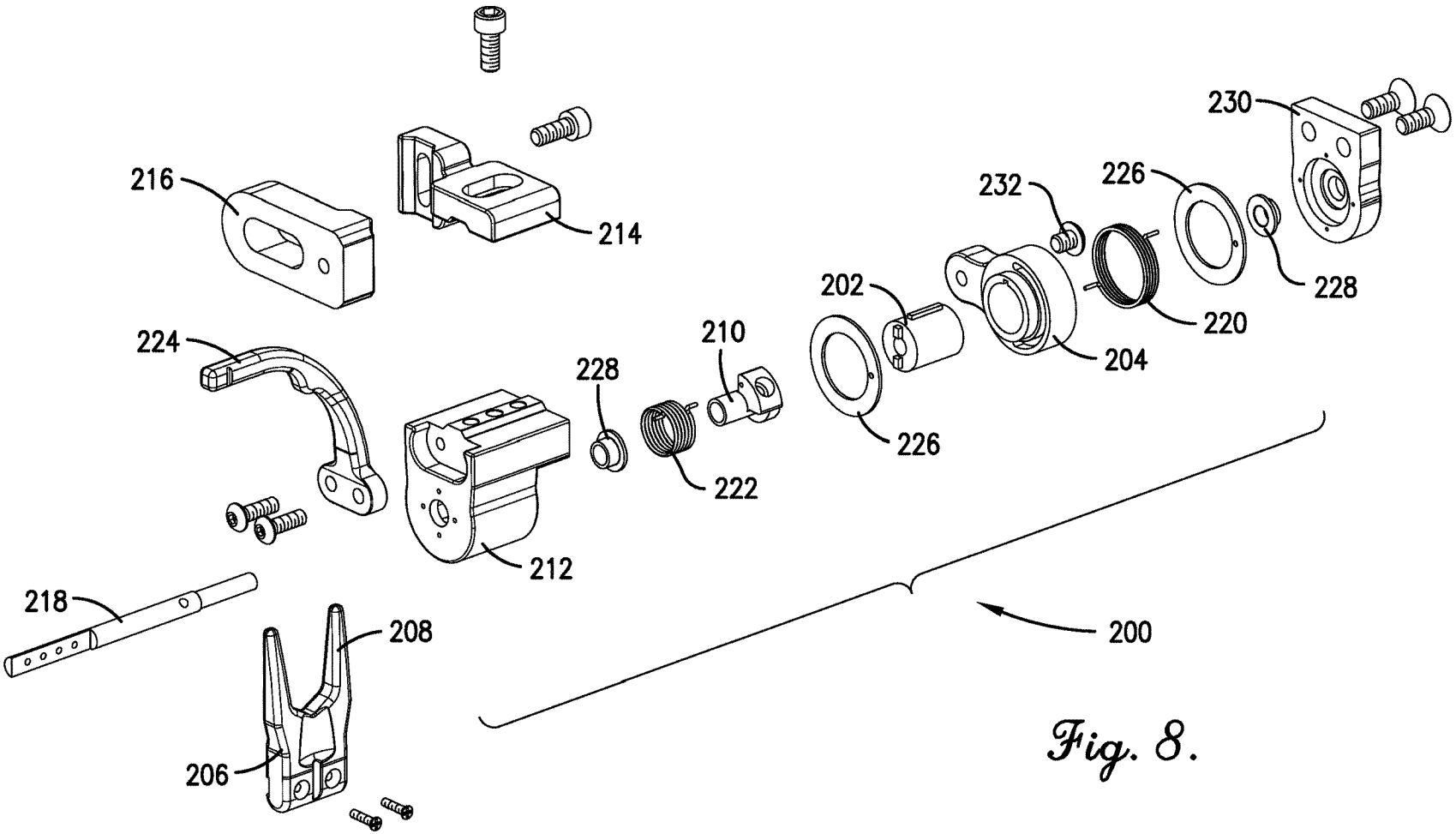
FIG. 8 is a frontal isometric exploded view of the arrow rest in accordance with one embodiment of the present invention.
Figure 9:
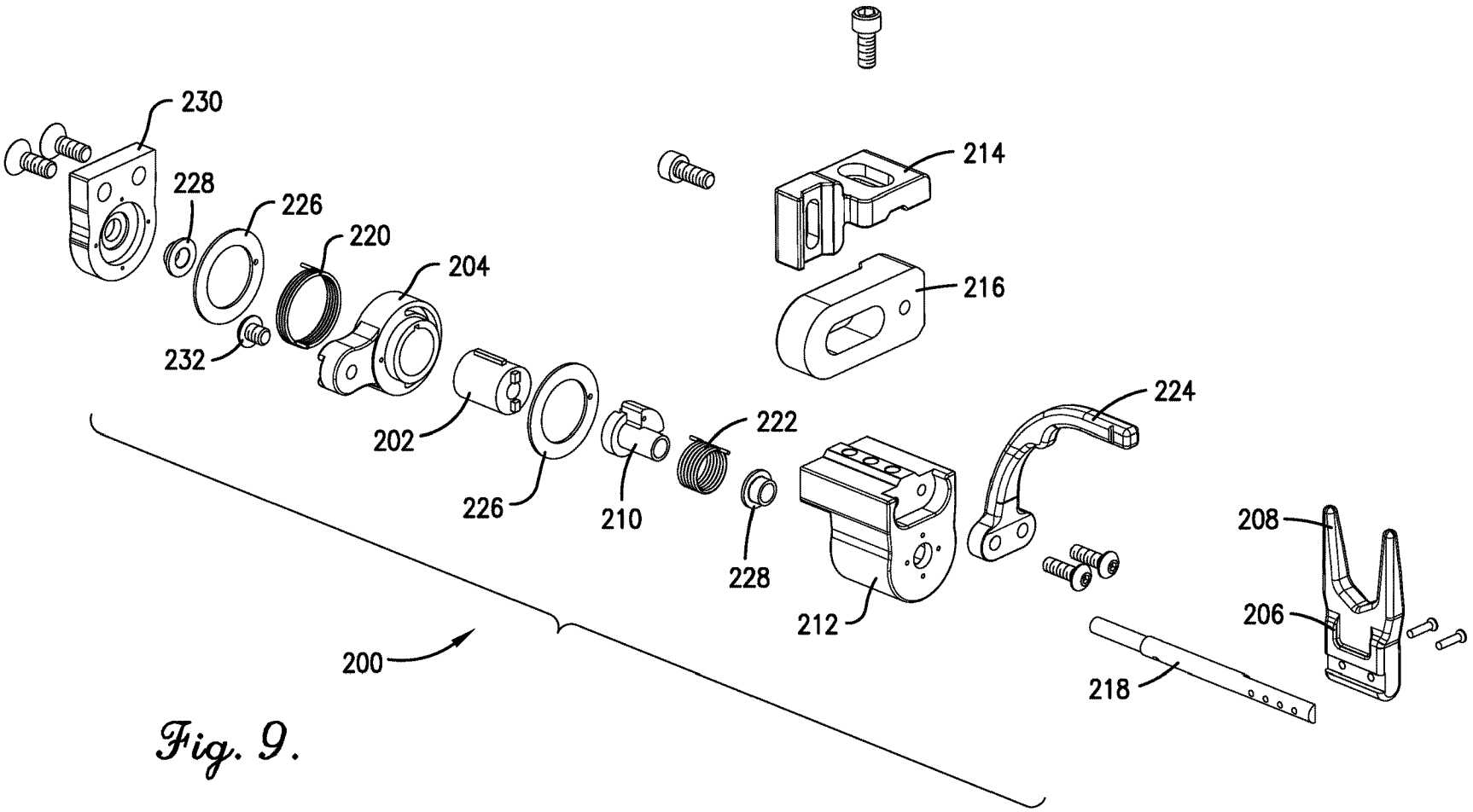
FIG. 9 is a rearward isometric exploded view of the arrow rest depicted in FIG. 8.

FIGS. 8 and 9 depict alternative exploded views of another embodiment of the arrow rest described above. As shown in FIGS. 8 and 9, the arrow rest 200 contains a torque transfer system 202, an actuation element 204, and a launcher 206 that are all operably connected. In this particular embodiment, the torque transfer system 202 is a rotary damper, the actuation element 204 is an actuation arm, and the launcher 206 is in the up position. The launcher 206 also contains a pair of launcher arms 208 designed to contain the arrow on the launcher 206. Additionally, a stop 210 in the form of an axle stop is located between the torque transfer system 202 and the launcher 206.

The arrow rest 200 also contains a body made up of a main body 212, an adjustable vertical body 214, and a riser mount 216 in the form of an attachment arm. The main body 212 provides structure to the arrow rest 200, while the riser mount 216 provides a mounting to connect the rest to an archery bow. The main body 212 also houses a main axle 218 that adjoins the torque transfer system 202, actuation element 204, launcher 206, and stop 210. The main axle 218 governs the rotation of the launcher 206.

The arrow rest 200 also contains a biasing system in the form of an actuation arm spring 220 and a launcher return spring 222. The actuation arm spring 220 is configured to urge the actuation element 204 into the initial position. The launcher return spring 222 is configured to urge the launcher 206 into the up position.

Additionally, a removable containment arm 224 is affixed onto the vertical body 214. The containment arm 224 extends over the launcher arms 208 to provide containment for the archer's arrow.

When the bow is drawn, the linkage (not shown) connecting the actuation element 204 to the buss cable (not shown) loses tension, thus allowing the actuation return spring 220 to rotate the actuation element 204 around the main axle 218 into the initial position.

Upon release of the drawn bow string, the launcher 206 remains in the up position until sufficient slack in the flexible linkage connecting the actuation element 204 to the buss cable is taken up by the shot cycle of the bow. As the arrow fletching approaches the rest during the shot, the increasing tension in the flexible linkage connecting the actuation element 204 to the buss cable causes the actuation element 204 to overcome the torsion of the actuation return spring 220 and rotate around the main axle 218 to the actuated position. Subsequently, the rotating actuation element 204 engages the torque transfer system 202 which in turn engages the launcher 206. During this time, the torque transfer system 202 can transfer the rotational motion from the actuation element 204 to the launcher 206, which momentarily overcomes the torsion of the launcher return spring 222, thereby causing the launcher 106 to rotate to its down position and out of the path of the incoming arrow. The down position of the launcher 206 is defined by the stop 210. Upon completion of the shot, the launcher return spring 222 returns the launcher 206 back to the up position.

The arrow rest 200 also contains washers 226, flanged bushing 228, and end cap 230, which along with the main body 212, house the main axle 218 in such a manner so as to allow free rotation of the axle. The arrow rest 200 in this embodiment also utilizes an actuation attachment bolt 232 to connect the actuation element 204 to the buss cable of the archery bow via a linkage or cord.

Figure 11:
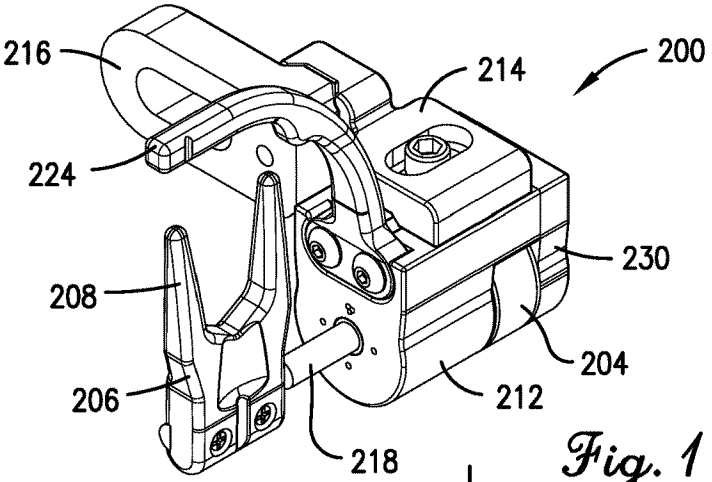
FIG. 11 is an isometric view of the assembled arrow rest depicted in FIG. 8.
Figure 10:
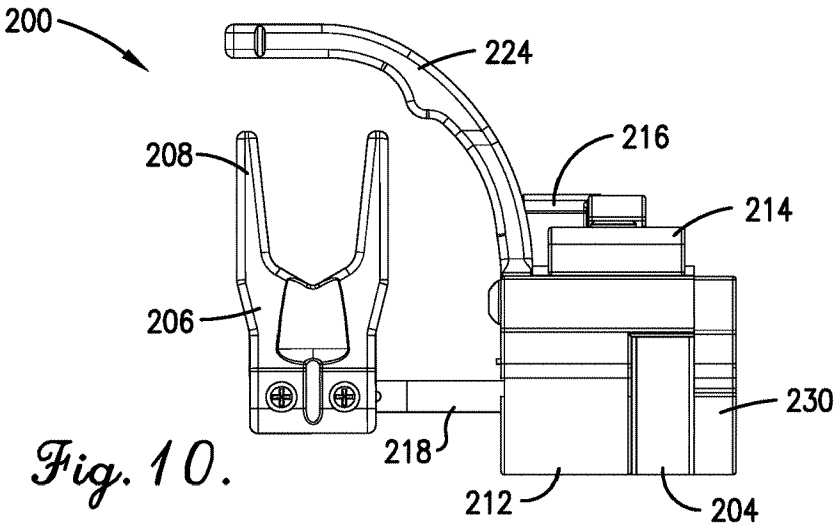
FIG. 10 is a side view of the assembled arrow rest depicted in FIG. 8.
Figure 12:
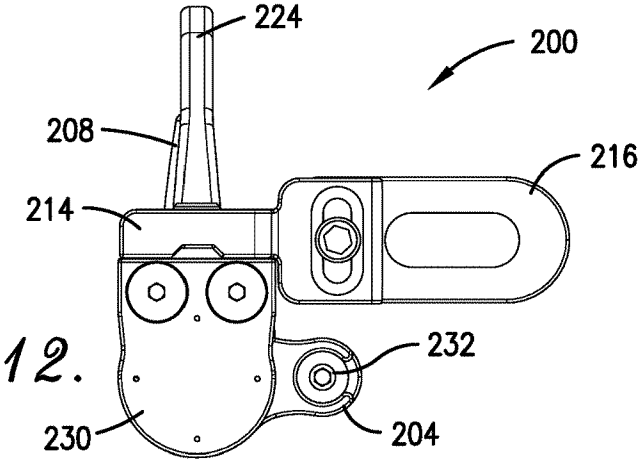
FIG. 12 is a side view of the assembled arrow rest depicted in FIG. 8.
Figure 15:
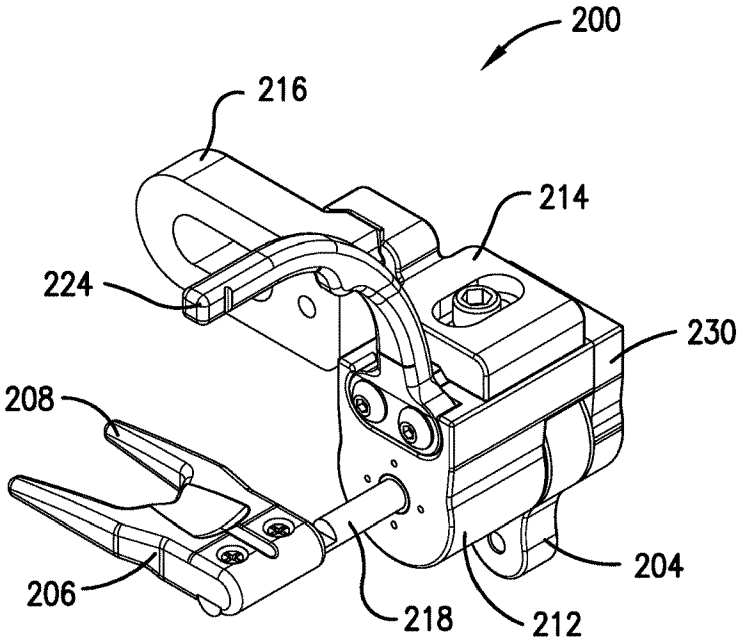
FIG. 15 is an isometric view of the assembled arrow rest depicted in FIG. 8, particularly illustrating when the launcher is in the down position.
Figure 14:
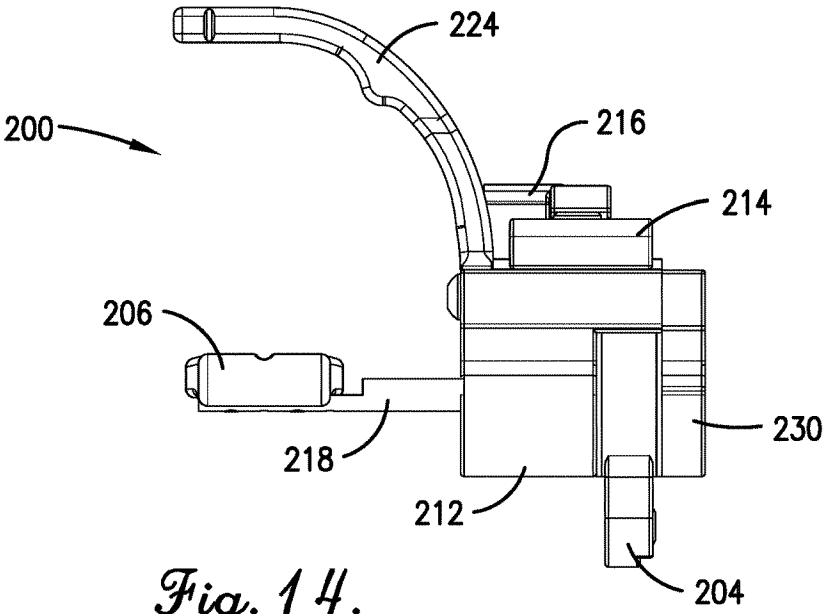
FIG. 14 is a side view of the assembled arrow rest depicted in FIG. 8, particularly illustrating when the launcher is in the down position.
Figure 17:
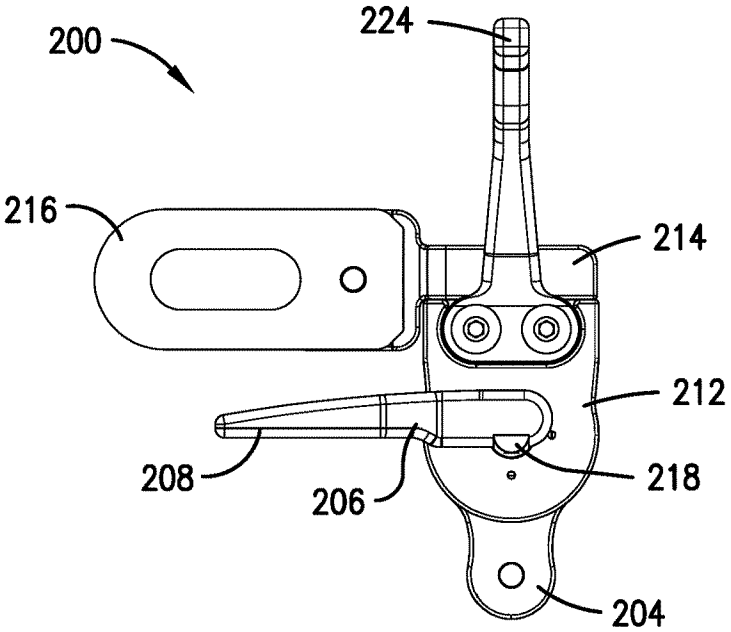
FIG. 17 is a side view of the assembled arrow rest depicted in FIG. 8, particularly illustrating when the launcher is in the down position.
Figure 16:
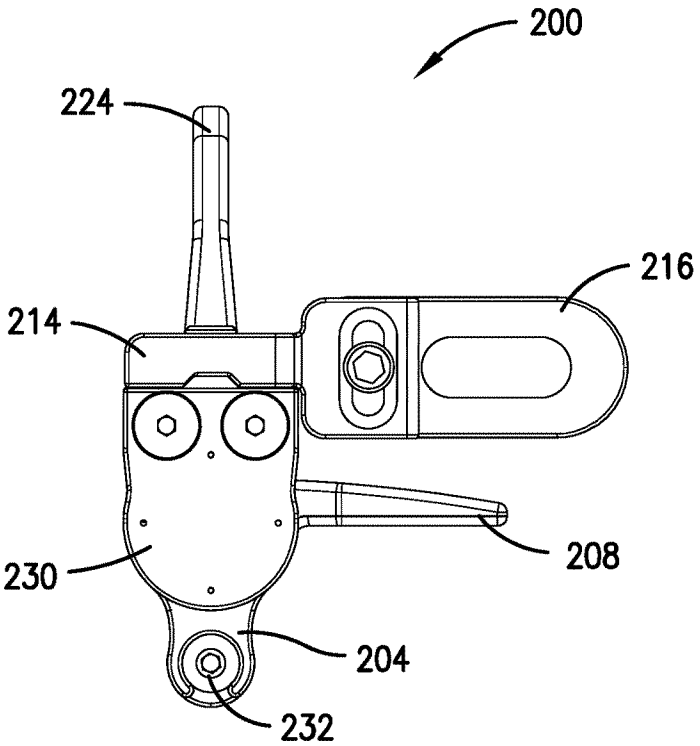
FIG. 16 is a side view of the assembled arrow rest depicted in FIG. 8, particularly illustrating when the launcher is in the down position.

FIGS. 10-12 depict alternative views of the assembled arrow rest embodiment depicted in FIGS. 8 and 9. The launcher 206 in FIGS. 10-12 is shown in the up position. In particular, FIGS. 10-12 further show how the actuation element 204, launcher 206, launcher arms 208, main body 212, adjustable vertical body 214, riser mount 216, main axle 218, containment arm 224, end cap 230, and actuation attachment bolt 232 are operably connected in the arrow rest 200.

FIG. 13 depicts an alternative view of the assembled arrow rest embodiment depicted in FIGS. 8 and 9. More specifically, FIG. 13 particularly illustrates the initial and actuated positions of the actuation element and the up and down positions of the launcher. As shown in FIG. 13, the actuation element rotates from the initial position to the actuated position through an actuation arm angle (angle A) and the launcher rotates from the up position to the down position through a launcher angle (angle B). In addition, FIG. 13 also depicts angle C which defines the rotation angle of the actuation arm past the down position of the launcher to the actuated position. While the actuation element rotates through angle C, the launcher is maintained at the down position with substantially no bounce back.

FIGS. 14-17 depict alternative views of the assembled arrow rest embodiment depicted in FIGS. 8 and 9. The launcher 206 in FIGS. 14-17 is shown in the down position. In particular, FIGS. 14-17 further show how the actuation element 204, launcher 206, launcher arms 208, main body 212, adjustable vertical body 214, riser mount 216, main axle 218, containment arm 224, end cap 230, and actuation attachment bolt 232 are operably connected in the arrow rest 200.

Figure 18:
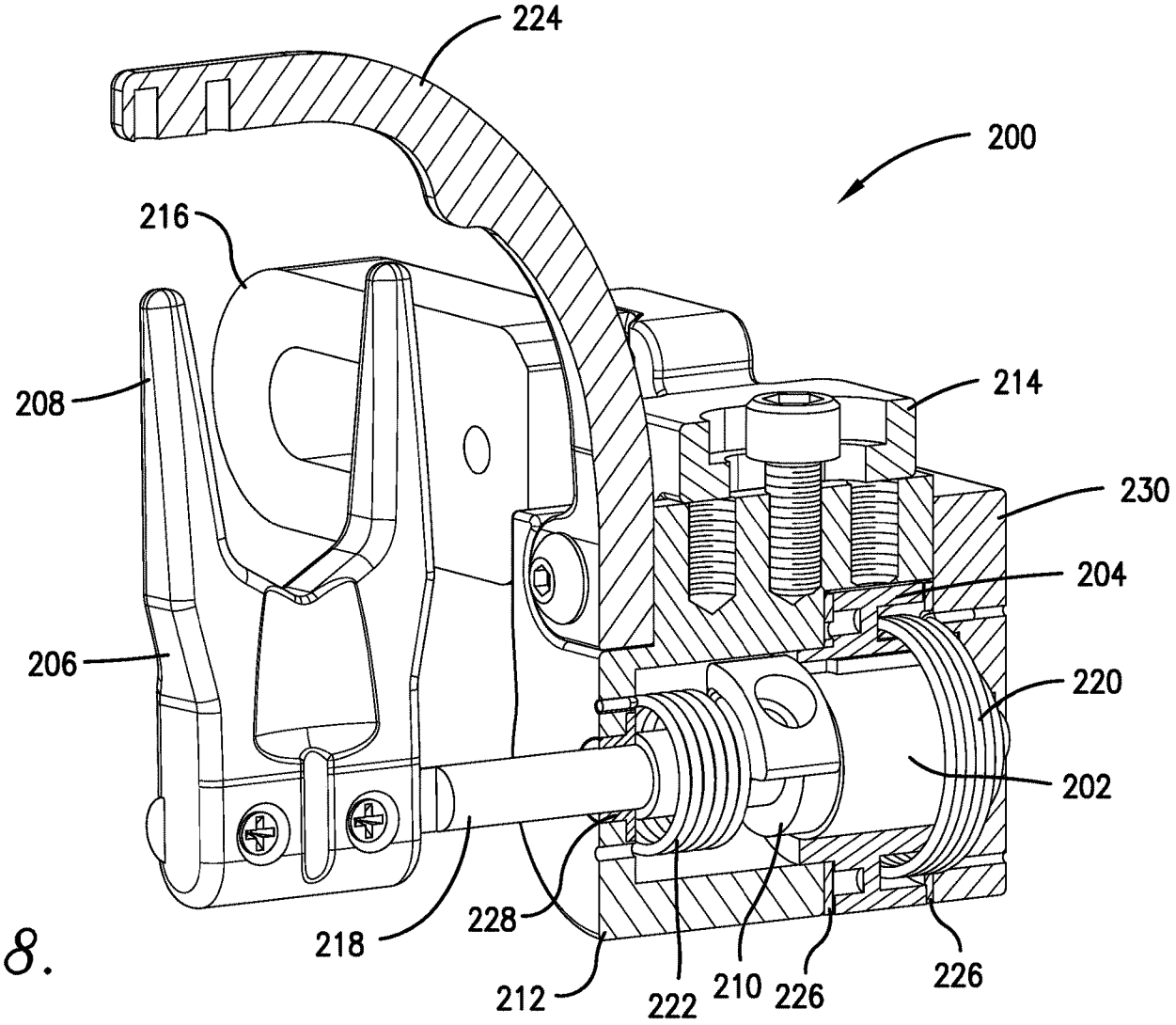
FIG. 18 is a cross-sectional view of the assembled arrow rest depicted in FIG. 8.

FIG. 18 depicts a cross-sectional view of the assembled arrow rest embodiment depicted in FIGS. 8 and 9. More specifically, FIG. 18 particularly illustrates the inner-connections in the arrow rest 200 between the torque transfer system 202, actuation element 204, launcher 206, stop 210, actuation return spring 220, and launcher return spring 222 within the main body 212.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. An arrow rest for an archery bow, said arrow rest comprising:

(a) a main body;

(b) a riser mount coupled to said main body for rigidly attaching said main body to the archery bow;

(c) a main axle including an internal portion received in said main body and an external portion extending out from said main body;

(d) a launcher coupled to said external portion of said main axle, wherein said launcher is rotatable relative to said main body between an up position and a down position, wherein said launcher is configured to receive and support an archery arrow when said launcher is in said up position;

(e) an actuation element comprising an actuation arm that is rotatable relative to said main body between an initial position and actuated position;

(f) a flexible cord having a first end coupled to said actuation arm and a second end configured for attaching to a buss cable of the archery bow so that downward movement of the buss cable during shooting of the archery bow causes downward movement of said actuation arm toward said actuated position;

(g) a rotary damper at least partly received in said main body, wherein said rotary damper comprises a first portion configured to rotate with said actuation element and an second portion configured to rotate with said main axle, wherein said rotary damper comprises a viscous fluid for providing speed-sensitive torque transfer between said actuation element and said main axle so that high speed rotation of said actuation element causes high speed rotation of said main axle and low speed rotation of said actuation element does not cause rotation of said main axle;

(h) an actuation arm spring biasing said actuation arm to rotate toward said initial position; and (i) a launcher return spring biasing said launcher to rotate toward said up position, wherein said actuation arm spring and said launcher return spring bias said actuation arm and said launcher, respectively, to rotate in the same direction of rotation, wherein said arrow rest is configured such that during shooting of the archery bow (i) said flexible cord shifts said actuation arm from said initial position to said actuated position, (ii) said rotary damper transmits high speed rotary motion of said actuation arm to said main axle, and (iii) said main axle rotates said launcher from said up position to said down position, wherein said arrow rest is configured such that immediately after shooting of the archery bow (i) tension in said flexible cord maintains said actuation arm in said actuated position, and (ii) said launcher return springs rotates said launcher from said down position to said up position, and wherein said arrow rest is configured such that during drawing of the archery bow (i) tension in said flexible cord is released, (ii) said actuation arm spring causes low speed rotation of said actuation arm from said actuated position to said initial position, and (iii) said launcher is maintained in said up position by said launcher return spring.

2. The arrow rest of claim 1, wherein said actuation element further comprises a base from which said actuation arm extends, wherein said base defines a base opening within which said rotary damper at least partly received.

3. The arrow rest of claim 2, wherein said rotary damper comprises a central opening through which said main axle extends.

4. The arrow rest of claim 3, wherein said first portion of said rotary damper comprises a first projection, wherein said base of said actuation element comprises a first recess, wherein said first projection is received in said first recess.

5. The arrow rest of claim 4, further comprising a stop coupled to said main axle and configured to restrict rotation of said launcher.

6. The arrow rest of claim 5, wherein said second portion of said rotary damper comprises a second projection, wherein said stop comprises a second recess, wherein said second projection is received in said second recess.

7. The arrow rest of claim 1, wherein said launcher comprises a pair of spaced apart launch arms rigidly coupled to said main axle.

8. The arrow rest of claim 1, wherein rotary damper, said actuation arm spring, and said launcher return spring are entirely housed within said main body.

* * * * *